United States Patent [19]

Van Tran

[11] Patent Number: 4,906,863

[45] Date of Patent: Mar. 6, 1990

[54] WIDE RANGE POWER SUPPLY BICMOS BAND-GAP REFERENCE VOLTAGE CIRCUIT

[75] Inventor: Hiep Van Tran, Carrollton, Tex.

[73] Assignee: Texas Instruments Incorporated, Dallas, Tex.

[21] Appl. No.: 161,694

[22] Filed: Feb. 29, 1988

[51] Int. Cl.[4] ..... G05F 1/46

[52] U.S. Cl. ..... 307/296.7; 307/310; 307/570; 323/313

[58] Field of Search ..... 307/446, 297, 310, 570; 323/313–314; 330/288

[56] References Cited

U.S. PATENT DOCUMENTS

| | | | |
|---|---|---|---|
| 4,380,706 | 4/1983 | Wrathall | 307/297 |
| 4,395,680 | 11/1982 | Hellums et al. | 323/313 |
| 4,472,675 | 9/1984 | Shinomiya | 323/314 |
| 4,495,425 | 1/1985 | McKenzie | 323/313 X |
| 4,525,663 | 6/1985 | Henry | 323/313 X |
| 4,588,941 | 5/1986 | Kerth et al. | 307/310 X |
| 4,595,874 | 6/1986 | Hein et al. | 323/313 X |
| 4,780,624 | 10/1988 | Nicollini et al. | 307/446 X |

*Primary Examiner*—David Hudspeth

*Attorney, Agent, or Firm*—Stanton Braden; Rodney M. Anderson; Melvin Sharp

[57] ABSTRACT

A BiCMOS bandgap reference voltage circuit is disclosed wherein substantial independence from a specified variation in supply voltage is accomplished through establishing a feedback loop between the output of the circuit and the input of the circuit such that the input is a function of the output.

22 Claims, 2 Drawing Sheets

WIDE RANGE POWER SUPPLY BICMOS BAND-GAP REFERENCE VOLTAGE CIRCUIT

BACKGROUND OF THE INVENTION

Bandgap reference voltage circuits are used to supply a relatively constant voltage for electronic circuits, especially those using emitter coupled logic (ECL). For instance, a bandgap reference voltage circuit generates a reference voltage for logic circuits such as current sources and/or input reference voltages in ECL gates.

Widlar bandgap reference voltage circuits as well as reference voltage circuits employing operational amplifiers (op amps) are typically used in the prior art. An explanation of the problems associated with prior art reference voltage circuits follows with reference to FIGS. 1 and 2.

FIG. 1 illustrates a Widlar bandgap reference voltage circuit. Current source 2, which derives its current from the circuit power supply (not shown), is connected to the base of transistor 4 and the collector of transistor 14. The emitter of transistor 4 supplies collector current 20 through resistor 6 and collector current 22 through resistor 8 to the collectors of transistors 10 and 12, respectively. The reference voltage, Vref, is determined by the voltage across resistor 8 plus the voltage across the base-emitter junction of transistor 14, $Vbe_{14}$. Neglecting the base current through transistor 12, current 22 is approximately equal to emitter current 24 through resistor 16. Since the voltage across resistor 16 is equal to the difference in the base-emitter voltages of transistors 10 and 12 or rather $\Delta Vbe$, the current through resistor 16 is $\Delta Vbe/R16$, where R16 is the value of resistor 16.

Neglecting base currents, the voltage drop across resistor 8 is simply $R8 \times \Delta Vbe/R16$, where R8 is the value of resistor 8. Therefore, Vref is equal to $Vbe_{14}+R8 \times \Delta Vbe/R16$. Many ECL devices require power supply operation ranges of 4.2 to 4.8 volts or 4.9 to 5.5 volts. The circuit described above and shown in FIG. 1 has one serious drawback in that the current from current source 2 is derived from the power supply and may vary with power supply voltage variations over a specified range. For many applications, variation of the reference voltage with a variation in the supply voltage over a specified range, is unsuitable for proper operation.

One possible solution in the prior art to curb reference voltage variation with respect to power supply variation is to provide a reference voltage circuit which includes an operational amplifier (op amp). A schematic drawing of this op amp reference circuit is illustrated in FIG. 2. FIG. 2 shows two diode configured transistors, 34 and 38 connected to the negative and positive input terminals, respectively, of op amp 40. Resistor 32 is connected to and between the negative terminal of op amp 40 and the collector of transistor 34. Current at node is fed back through resistors 30 (which is connected to resistor 32), and 32 and through resistor 36 which is connected to the collector of transistor 38. Assuming that base currents of transistors 34 and 38 are negligible and that the differential input of op am 40 is zero, i.e. $\Delta V=0$, then an expression for Vref is $Vbel+KV_T$, where Vbel is the base-emitter voltage of transistor 38, K is a constant and $V_T$ is the electronvolt equivalent of the temperature. As observed, the expression for Vref shows some independence from voltage supply variation. However, implementation of the circuit illustrated in FIG. 2 requires an op amp with very precise components which add to the complexity and cost of the voltage reference band-gap circuit.

OBJECTS OF THE INVENTION

It is an object of the invention to provide a new and improved band-gap reference voltage circuit.

It is an object of the invention to provide a new and improved BiCMOS band-gap reference voltage circuit that does not vary substantially with a specified range of variations in the supply voltage to the band-gap reference voltage circuit.

It is an object of the invention to provide a new and improved band-gap reference voltage circuit whose input to the circuit depends on the output of the circuit.

It is an object of the invention to provide a band-gap reference voltage circuit which includes lo complexity circuitry.

It is an object of the invention to provide a new and improved band-gap reference circuit that includes a start-up subcircuit.

These and other objects of the invention, together with the features and advantages thereof, will become apparent from the detailed specification when read together with the accompanying drawings.

SUMMARY OF THE INVENTION

The foregoing objects of the invention are accomplished by a band-gap reference voltage circuit which comprises a first device that includes at least a first and second terminal wherein the voltage of and current through the first terminal controls the voltages of and currents through the remaining terminals. The first device can be a transistor, including a bipolar transistor. The current through the second terminal of the first device provides a reference current for the rest of the circuit. This reference current is mirrored through a current mirror means which is connected to a band-gap sub-circuit means. The band-gap sub-circuit means provides a voltage and current to the first terminal, both of which are determined by the reference current. The voltage of the first terminal is the reference voltage for the band-gap reference voltage circuit and means are included for insuring that this voltage is substantially constant.

DETAILED DESCRIPTION OF THE INVENTION

Figure 1:
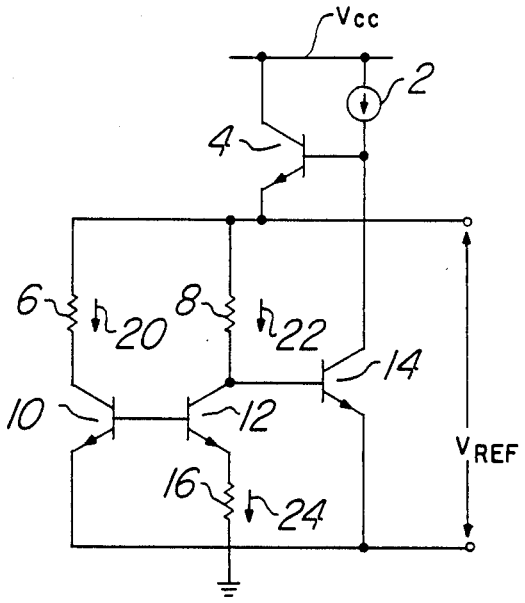
Fig. 1 PRIOR ART
FIG. 1 is a schematic drawing of a prior art band-gap reference voltage circuit, more specifically a Widlar bandgap reference voltage circuit.
Figure 2:
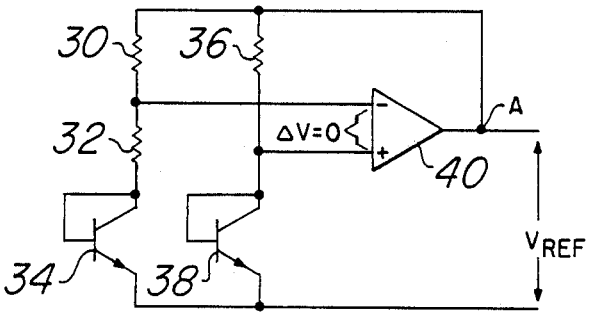
Fig. 2 PRIOR ART
FIG. 2 is a schematic drawing of a prior art band-gap reference voltage circuit including an operational amplifier.
Figure 3:
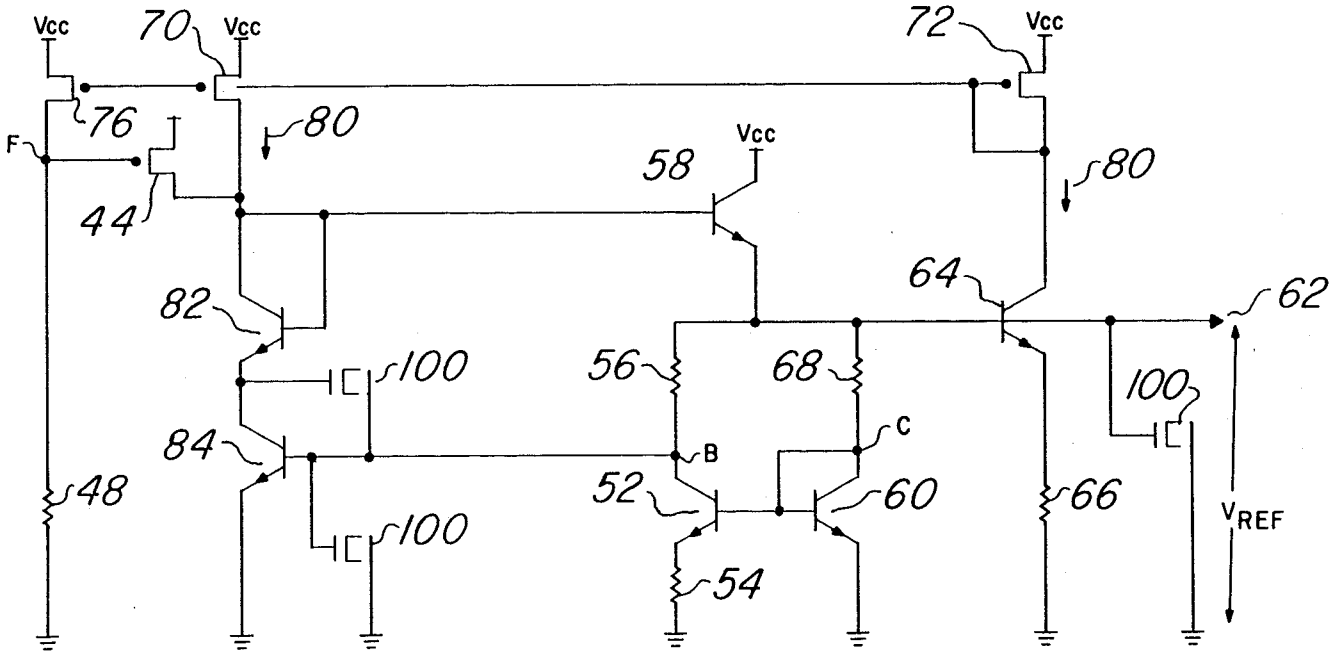
FIG. 3 is a schematic drawing of the preferred embodiment of the invention.

FIG. 3 is a schematic drawing of a preferred embodiment of the BiCMOS bandgap reference voltage circuit. It may typically operate with a wide ranging power supply which ranges from 3.5 to greater than 6 volts. Bipolar transistors 52, 60 and 58 comprise a band-gap sub-circuit. Transistors 52 and 60 share a common base with transistor 60 in a diode configuration such that its collector is tied to its base. The collector of transistor 52 is connected at node B to resistor 56 and the collector of transistor 60 is connected at node C to resistor 68. Both resistors 56 and 68 are connected together and to the emitter of transistor 58. Resistor 54 is connected to the emitter of transistor 52 and ground. The collector of transistor 58 is tied to voltage, Vcc.

P-channel transistors 70 and 72 share a common gate and comprise a current mirror. Transistor 72 is shown with its drain tied to its gate.

P-channel transistors 44, and 76 comprise start-up circuitry for starting the operation of the reference voltage circuit. Transistor 76 shares its gate with transistor 70 and has its drain connected at node F to the gate of transistor 44. Resistor 48 is connected between node F and ground.

Voltage regulator circuitry comprises bipolar transistors 82 and 84. Transistor 82 is connected in a diode configuration with its base tied to its collector. The emitter of transistor 82 is connected to the collector of bipolar transistor 84. The emitter of bipolar transistor 84 is connected to ground while its base is connected to the collector of transistor 52.

Means for establishing reference current for the circuit comprises bipolar transistor 64 with its base connected to the emitter of transistor 58 and its collector tied to the drain and gate of transistor 72. The emitter of transistor 64 is connected to resistor 66 which is connected to ground. A reference voltage, is established at output 62, which is the base of transistor 64.

Operation of the circuit follows. A first equilibrium state for the circuit exists when the power supply voltage is at zero. In this state, there is no current flowing in the circuit. However, when the power supply voltage is increased from zero, p-channel transistors 76 and 44 comprise a start-up sub-circuit wherein p-channel transistor 44 turns on due to the low potential at its gate through resistor 48. A current path is therefore provided from Vcc, the circuit supply voltage, to the gate of bipolar transistor 58. Note that the start-up sub-circuitry can alternatively include bipolar transistors.

Transistor 58 provides current to bandgap reference voltage sub-circuit. A reference voltage at output 62 is provided which approximately equals ($\Delta$Vbe60-52)X+Vbe60 where $\Delta$Vbe60-52 is the difference between the base emitter drop of transistors 60 and 52, X equals the ratio of the value of resistor 56 (which equals the value of resistor 68) over the value of resistor 54, and Vbe60 is the base-emitter drop of transistor 60. The above values are obtained by noting that transistor 84 is connected at its base to the collector of transistor 52. Furthermore, note that in this preferred embodiment the size of transistor 84 is the same size as transistor 60, which constrains the base-emitter voltages of transistors 60 and 84 to be the same and the voltages at nodes B, and C to be equal. Note, however, that the relative values for the above components are given for example only and that therefore they are only one set of many possibilities.

The reference voltage at output 62 biases the base of transistor 64, turning on p-channel transistor 72 by causing its gate to drop in voltage due to the connection of the drain of transistor 72 with its own gate and with the collector of transistor 64. P-channel transistor 70 is preferably the same size as p-channel transistor 72. Current 80 flows through transistor 72 which, neglecting base currents, is equal to the reference voltage at output 62 minus the base-emitter drop of transistor 64, all divided by the value of resistor 66 which is connected to the emitter of transistor 64. Current 80 through transistor 72 mirrors and flows through transistor 70 (meaning current equal in value or functionally related to current 80 flows through transistor 70) while p-channel transistor 76 shuts transistor 44 off by pulling node F up in voltage. Current 80 provides a reference current which is independent of power supply variations within a specified range (typically approximately 3.1 volts) for the voltage band-gap reference circuit. Reference current 80 is a function of the reference voltage at output 62, and allows the output of the band-gap circuit to control its input. Note that circuitry including bipolar transistors could perform the current mirroring function described above.

At the time transistor 44 is turned off, the start-up sub-circuit comprising transistors 44 and 76 is effectively removed from the band-gap circuit thereby allowing a second circuit equilibrium state for the band-gap circuit to exist. Mirrored current 80 flows through diode configured transistor 82 and into the collector of error feedback amplifier bipolar transistor 84. In this second equilibrium state, a decrease in voltage at the base of transistor 84 causes an increase in voltage at the base of transistor 58 so as to raise back up the voltage at the base of transistor 84 and thus maintain a constant output voltage. Additionally, an increase in voltage at the base of transistor 84 correspondingly causes a decrease in voltage at the base of transistor 58 so as to bring back down the voltage at the base of transistor 84, thereby maintaining the reference voltage at output 62. The circuit just described and shown in FIGURE delivers a reference voltage, Vref, and a reference current, current 80 which is virtually independent of variations in the supply voltage to the extent of supply voltage variations equal to approximately Vref+the base-emitter drop of transistor 58 + the threshold voltage of transistor 72 or assuming typical values, 3.1 volts.

For stability purposes, MOS capacitors 100 may be inserted between the collector and the emitter of transistor 84 and between the base and emitter of transistor 84. Additionally, a capacitor across output 62 and ground also benefits circuit stability.

Although the invention has been described in detail herein with reference to its preferred embodiment and certain described alternatives, it is to be understood that this description is by way of example only, and is not to be construed in a limiting sense. It is to be further understood that numerous changes in the details of the embodiments of the invention, and additional embodiments of the invention, will be apparent to and may be made by persons of ordinary skill in the art having reference to this description. It is contemplated that all such changes and additions are within the spirit and true scope of the invention as claimed below. Accordingly, the invention is intended to be limited only by the scope of the appended claims.

I claim:

1. A band-gap reference voltage circuit comprising:

a device capable of producing a reference current output including at least a first and second terminal wherein the bias of said first terminal controls said reference current through said second terminal;

a band-gap reference sub-circuit operable to transmit a substantially constant reference voltage output;

a voltage regulator device operable to maintain a substantially constant voltage at at least one selected node of said band-gap reference sub-circuit; and a current mirror coupled to said second terminal of said reference current producing device and to said band-gap reference sub-circuit, said current mirror being operable to determine the bias provided by said band-gap reference sub-circuit, said current mirror being further operable to mirror said reference current from said reference current producing device to said voltage regulator device.

2. A band-gap reference voltage circuit as recited in claim 1 wherein said current mirror comprises a transistor connected to said band-gap reference sub-circuit and a diode operable to receive said reference current from said reference current producing device, said diode being connected to said second terminal of the latter and to said transistor.

3. A band-gap reference voltage circuit as recited in claim 2 wherein said diode comprises a field effect transistor including its drain connected to its gate.

4. A band-gap reference voltage circuit as recited in claim 2 wherein said transistor is a field effect transistor.

5. A band-gap reference voltage circuit as recited in claim 1 wherein said band-gap sub-circuit comprises two bipolar transistors including a common base and a control transistor connected to the collectors of said bipolar transistors.

6. A band-gap reference voltage circuit as recited in claim 5 wherein one said bipolar transistors is configured as a diode.

7. A band-gap reference voltage circuit as recited in claim 1 which further includes start-up circuitry for initially turning on said band-gap reference voltage circuit.

8. A band-gap reference voltage circuit as recited in claim 7 wherein said start-up circuitry includes first and second field effect transistors including a common gate and being connected to a third field effect transistor.

9. A band-gap reference voltage circuit as recited in claim 7 wherein said start-up circuitry includes a plurality of bipolar transistors connected together.

10. A band-gap reference voltage circuit as recited in claim 1 wherein said voltage regulator comprises a diode configured transistor connected to the collector of a bipolar transistor.

11. A band-gap reference voltage circuit comprising:

a bipolar transistor capable of producing a reference current;

a band-gap reference sub-circuit operable to transmit a substantially constant reference voltage output;

a voltage regulator device operable to maintain a substantially constant voltage at at least one selected node of said band-gap reference sub-circuit; and a current mirror coupled to both said bipolar transistor and said band-gap reference sub-circuit, said current mirror being operable to mirror said reference current from said bipolar transistor to said voltage regulator device.

12. A band-gap reference voltage circuit comprising:

a device capable of producing a substantially constant reference current;

a band-gap reference sub-circuit coupled to said reference current device, operable to transmit a substantially constant reference voltage output;

a voltage regulator device; and a current mirror being operable to mirror said reference current from said reference current producing device to said voltage regulator device.

13. A band-gap reference voltage circuit comprising:

a bipolar transistor capable of producing a substantially constant reference current;

a band-gap reference sub-circuit coupled to said bipolar transistor, operable to transmit a substantially constant reference voltage output;

a voltage regulator device;

a current mirror comprising first and second field-effect transistors, said field effect transistors sharing common gate connections and said first field effect transistor having its drain connected to its gate, said current mirror being operable to mirror said reference current from said reference current producing bipolar transistor to said voltage regulator device.

14. A band-gap reference voltage circuit as recited in claim 13 which further comprises a bipolar transistor coupled to said band-gap reference sub-circuit and said voltage regulator device, said bipolar transistor being operable to buffer the output of said voltage regulator device.

15. A band-gap reference voltage circuit as recited in claim 13 wherein said voltage regulator device includes a bipolar transistor.

16. A band-gap reference voltage circuit as recited in claim 13 wherein said field effect transistors are p-channel transistors.

17. A band-gap reference voltage circuit as recited in claim 16 wherein said p-channel transistors are MOS transistors.

18. A band-gap reference voltage circuit as recited in claim 13 which further comprises start-up circuitry.

19. A band-gap reference voltage circuit as recited in claim 18 wherein said start-up circuitry comprises at least one field-effect transistor.

20. A band-gap reference voltage circuit as recited in claim 18 wherein said start-up circuitry comprises at least one bipolar transistor.

21. A band-gap reference voltage circuit as recited in claim 20 wherein said start-up circuitry further comprises at least one field-effect transistor.

22. A method for providing a reference voltage which is substantially independent of power supply variations comprising the steps of:

producing a reference voltage;

producing a reference current derived from said reference voltage; and mirroring said reference current so as to control the production of said reference voltage, said control resulting in a substantially constant reference voltage.

* * * * *

US004906863C1

(12) EX PARTE REEXAMINATION CERTIFICATE (4991st)

United States Patent
Tran

(10) Number: US 4,906,863 C1
(45) Certificate Issued: Sep. 21, 2004

(54) WIDE RANGE POWER SUPPLY BICMOS BAND-GAP REFERENCE VOLTAGE CIRCUIT

(75) Inventor: Hiep Van Tran, Carrollton, TX (US)

(73) Assignee: Texas Instruments Incorporated, Dallas, TX (US)

Reexamination Request:
No. 90/006,582, Apr. 3, 2003

Reexamination Certificate for:

| | |
|---|---|
| Patent No.: | **4,906,863** |
| Issued: | **Mar. 6, 1990** |
| Appl. No.: | **07/161,694** |
| Filed: | **Feb. 29, 1988** |

(51) Int. Cl.[7] ..... G05F 1/46
(52) U.S. Cl. ..... 327/539; 323/313; 326/126; 327/433; 327/542
(58) Field of Search ..... 327/530, 534, 327/535, 537, 538, 539, 540, 541, 542, 543, 433; 323/313; 326/126

(56) References Cited

U.S. PATENT DOCUMENTS

| | | | | |
|---|---|---|---|---|
| 3,820,007 A | | 6/1974 | Schilling et al. | |
| 4,359,680 A | | 11/1982 | Hellums et al. | |
| 4,380,706 A | * | 4/1983 | Wrathall | 327/539 |
| 4,395,680 A | * | 7/1983 | Slutzky | 324/392 |
| 4,471,292 A | | 9/1984 | Schenck et al. | |
| 4,472,675 A | * | 9/1984 | Shinomiya | 323/314 |
| 4,495,425 A | * | 1/1985 | McKenzie | 327/541 |
| 4,525,663 A | * | 6/1985 | Henry | |
| 4,588,941 A | * | 5/1986 | Kerth et al. | 323/314 |
| 4,595,874 A | * | 6/1986 | Hein et al. | 323/312 |
| 4,672,304 A | | 6/1987 | Degrauwe et al. | |
| 4,780,624 A | * | 10/1988 | Nicollini et al. | 327/541 |
| 4,820,967 A | | 4/1989 | Kertis et al. | |

FOREIGN PATENT DOCUMENTS

| | | |
|---|---|---|
| JP | 58-112112 | 7/1983 |
| JP | 61-246818 | 12/1986 |
| JP | 61-289415 | 12/1986 |

OTHER PUBLICATIONS

Brokaw, *A Simple Three–Terminal IC Bandgap Reference,* IEEE Journal of Solid State Circuits, vol. SC–9, No. 6, Dec. 1974.
Widlar, *National Semiconductor Application Note 42,* Feb. 1971.
Degrauwe et al., *CMOS Voltage References Using Lateral Bipolar Transistors,* IEEE Journal of Solid State Circuits, vol. SC–20, No. 6, Dec. 1985.
Gray et al., *Analysis and Design of Integrated Circuits,* 284–297 (1984).
Tsividis, *Design Considerations in Single–Channel MOS Analog Integrated Circuits—A Tutorial,* IEEE Journal of Solid State Circuits, vol. SC–13, No. 3, Jun. 1978.
Analog Devices AD580 Datasheet, 1984.
Motorola MC1403,A/MC1503,A Datasheet, 1986.
Motorola MC1403,A/MC1503,A Datasheet, 1988.
Motorola MC7800 Series Datasheet, 1988.
National Semiconductor LM109/LM209/LM309 Datasheet, 1982.
Linear Technology LT1009 Series Datasheet, 1985.

* cited by examiner

*Primary Examiner*—Jeffrey Zweizig

(57) ABSTRACT

A BiCMOS bandgap reference voltage circuit is disclosed wherein substantial independence from a specified variation in supply voltage is accomplished through establishing a feedback loop between the output of the circuit and the input of the circuit such that the input is a function of the output.

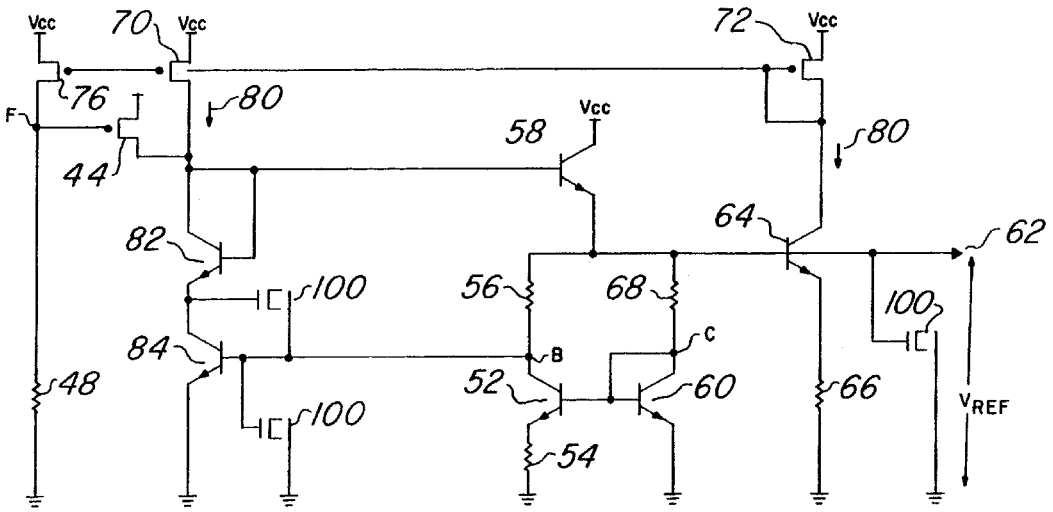

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 5, 7, 9, 11–13, 17, 18 and 22 are determined to be patentable as amended.

Claims 2–4, 6, 8, 10, 14–16 and 19–21, dependent on an amended claim, are determined to be patentable.

New claims 23–145 are added and determined to be patentable.

1. A *BiCMOS* band-gap reference voltage circuit comprising:

a device capable of producing a reference current output including at least a first and second terminal wherein the bias of said first terminal controls said reference current through said second terminal;

a band-gap reference sub-circuit operable to transmit a substantially constant reference voltage output, *the band-gap reference sub-circuit having plural current paths coupled between a common terminal and a reference terminal*;

a voltage regulator device operable to maintain a substantially constant voltage at at least one selected node of said band-gap reference sub-circuit; [and]

a current mirror coupled to said second terminal of said reference current producing device and to said band-gap reference sub-circuit, said current mirror being operable to determine the bias provided by said band-gap reference sub-circuit, said current mirror being further operable to mirror said reference current from said reference current producing device to said voltage regulator device*; and*

*a start-up circuit coupled between the current mirror and the common terminal.*

5. A band-gap reference voltage circuit as recited in claim 1 wherein said band-gap sub-circuit comprises two bipolar transistors including a common base and a control transistor connected to the [collectors of said bipolar transistors] *common terminal.*

7. A band-gap reference voltage circuit as recited in claim 1 [which further includes] *wherein said* start-up circuitry *receives current through a field effect transistor* for initially turning on said band-gap reference voltage circuit.

9. A band-gap reference voltage circuit as recited in claim 7 wherein said start-up circuitry includes [a plurality of bipolar transistors connected together] *at least one bipolar transistor.*

11. A band-gap reference voltage circuit comprising:

a bipolar transistor capable of producing a reference current;

a band-gap reference sub-circuit operable to transmit a substantially constant reference voltage output;

a voltage regulator device operable to maintain a substantially constant voltage at at least one selected node of said band-gap reference sub-circuit; [and]

a *field effect transistor* current mirror coupled to both said bipolar transistor and said band-gap reference sub-circuit, said *field effect transistor* current mirror being operable to mirror said reference current from said bipolar transistor to said voltage regulator device*; and*

*a start-up circuit coupled to the field effect transistor current mirror.*

12. A *BiCMOS* band-gap reference voltage circuit comprising:

a device capable of producing a substantially constant reference current;

a band-gap reference sub-circuit coupled to said reference current device, operable to transmit a substantially constant reference voltage output;

a voltage regulator device;

*a start-up circuit coupled to the voltage regulator device;* and a current mirror being operable to mirror said reference current from said reference current producing device to said voltage regulator device.

13. A *BiCMOS* band-gap reference voltage circuit comprising:

a bipolar transistor capable of producing a substantially constant reference current;

a band-gap reference sub-circuit coupled to said bipolar transistor, operable to transmit a substantially constant reference voltage output, *the band-gap reference sub-circuit having plural current paths coupled between a common terminal and a reference terminal*;

a voltage regulator device;

a current mirror comprising first and second field-effect transistors, said field effect transistors sharing common gate connections and said first field effect transistor having its drain connected to its gate, said current mirror being operable to mirror said reference current from said reference current producing bipolar transistor to said voltage regulator device*; and*

*a start-up circuit coupled to the common terminal.*

17. A band-gap reference voltage circuit as recited in claim [16] *13* wherein [said p-channel transistors are MOS transistors] *the current mirror is coupled to a current path of the device and to a current path of the voltage regulator device.*

18. A band-gap reference voltage circuit as recited in claim 13 [which further comprises start-up circuitry] *comprising a control transistor having a control terminal and a current path, the control terminal coupled to the current mirror and the current path coupled to the common terminal.*

22. A method for providing a reference voltage which is substantially independent of power supply variations comprising the steps of:

producing a reference voltage;

*regulating the reference voltage, thereby producing a regulated reference voltage;*

*applying a start-up current to the step of regulating for starting the step of producing;* producing a reference current derived from said *regulated* reference voltage; and mirroring said reference current *with a plurality of field effect transistors* so as to control the production of said reference voltage, said control resulting in a substantially constant reference voltage.

*23. A BiCMOS band-gap reference voltage circuit comprising:*

*a device capable of producing a substantially constant reference current;*

*a band-gap reference sub-circuit coupled to said reference current device, operable to transmit a substantially constant reference voltage output;*

*a voltage regulator device;*

*a current mirror being operable to mirror said reference current from said reference current producing device to said voltage regulator device; and*

*a diode coupled between the voltage regulator device and the current mirror.*

*24. A BiCMOS band-gap reference voltage circuit as in claim 23, wherein the current mirror comprises a plurality of field effect transistors.*

*25. A BiCMOS band-gap reference voltage circuit as in claim 23, wherein the device includes a control terminal and a current path, the current path being connected to a voltage supply terminal without an intervening transistor.*

*26. A BiCMOS band-gap reference voltage circuit as in claim 23, comprising a start-up circuit, wherein the band-gap reference sub-circuit comprises plural current paths coupled between a common terminal and a reference terminal, and wherein the start-up circuit is coupled between the current mirror and the common terminal.*

*27. A BiCMOS band-gap reference voltage circuit as in claim 23, comprising a start-up circuit, wherein the band-gap reference sub-circuit comprises plural current paths coupled between a common terminal and a reference terminal, and wherein the start-up circuit is coupled to the common terminal.*

*28. A BiCMOS band-gap reference voltage circuit as in claim 23, wherein the band-gap reference sub-circuit comprises a control transistor having a control terminal and a current path, the control terminal coupled to the current mirror and the current path coupled to the common terminal.*

*29. A BiCMOS band-gap reference voltage circuit as in claim 23, wherein each of the device and the voltage regulator device include respective current paths, and wherein each respective current path is coupled to the current mirror.*

*30. A BiCMOS band-gap reference voltage circuit as in claim 23, wherein the band-gap reference sub-circuit comprises a control transistor having a control terminal and a current path, the control terminal coupled to the voltage regulator device.*

*31. A BiCMOS band-gap reference voltage circuit as in claim 23, wherein the device includes a control terminal, and wherein the band-gap reference sub-circuit comprises a control transistor having a control terminal and a current path, and the current path of the control transistor coupled to the control terminal of the device.*

*32. A BiCMOS band-gap reference voltage circuit comprising:*

*a device capable of producing a substantially constant reference current;*

*a band-gap reference sub-circuit coupled to said reference current device, operable to transmit a substantially constant reference voltage output;*

*a voltage regulator device;*

*a current mirror being operable to mirror said reference current from said reference current producing device to said voltage regulator device; and*

*a start-up circuit coupled to the current mirror.*

*33. A BiCMOS band-gap reference voltage circuit as in claim 32, wherein the current mirror comprises a plurality of field effect transistors.*

*34. A BiCMOS band-gap reference voltage circuit as in claim 32, wherein the device includes a control terminal and a current path, the current path being connected to a voltage supply terminal without an intervening transistor.*

*35. A BiCMOS band-gap reference voltage circuit as in claim 32, comprising a diode coupled between the voltage regulator device and the current mirror.*

*36. A BiCMOS band-gap reference voltage circuit as in claim 32, comprising a diode coupled to the start-up circuit.*

*37. A BiCMOS band-gap reference voltage circuit as in claim 32, wherein the band-gap reference sub-circuit comprises plural current paths coupled between a common terminal and a reference terminal, and wherein the start-up circuit is coupled between the current mirror and the common terminal.*

*38. A BiCMOS band-gap reference voltage circuit as in claim 32, wherein the band-gap reference sub-circuit comprises plural current paths coupled between a common terminal and a reference terminal, and wherein the start-up circuit is coupled to the common terminal.*

*39. A BiCMOS band-gap reference voltage circuit as in claim 32, wherein the band-gap reference sub-circuit comprises a control transistor having a control terminal and a current path, the control terminal coupled to the current mirror and the current path coupled to the commomn terminal.*

*40. A BiCMOS band-gap reference voltage circuit as in claim 32, wherein each of the device and the voltage regulator device include respective current paths, and wherein each respective current path is coupled to the current mirror.*

*41. A BiCMOS band-gap reference voltage circuit as in claim 32, wherein the band-gap reference sub-circuit comprises a control transistor having a control terminal and a current path, the control terminal coupled to the voltage regulator device.*

*42. A BiCMOS band-gap reference voltage circuit as in claim 32, wherein the device includes a control terminal, and wherein the band-gap reference sub-circuit comprises a control transistor having a control terminal and a current path, and the current path of the control transistor coupled to the control terminal of the device.*

*43. A BiCMOS band-gap reference voltage circuit comprising:*

*a device capable of producing a substantially constant reference current, the device having a control terminal and a current path;*

*a band-gap reference sub-circuit coupled to said reference current device, operable to transmit a substantially constant reference voltage output, the band-gap reference sub-circuit having plural current paths coupled between a common terminal and a reference terminal and having a control transistor coupled to the common terminal and to the control terminal of the device;*

*a voltage regulator device; and*

*a current mirror being operable to mirror said reference current from said reference current producing device to said voltage regulator device.*

*44. A BiCMOS band-gap reference voltage circuit as in claim 43, wherein the current mirror comprises a plurality of field effect transistors.*

*45. A BiCMOS band-gap reference voltage circuit as in claim 43, wherein the device includes a control terminal and*

*a current path, the current path being connected to a voltage supply terminal without an intervening transistor.*

*46. A BiCMOS band-gap reference voltage circuit as in claim 43, comprising a start-up circuit coupled to the current mirror.*

*47. A BiCMOS band-gap reference voltage circuit as in claim 43, comprising a start-up circuit coupled between the current mirror and the common terminal.*

*48. A BiCMOS band-gap reference voltage circuit as in claim 43, comprising a start-up circuit is coupled to the common terminal.*

*49. A BiCMOS band-gap reference voltage circuit as in claim 43, wherein a control terminal of the control transistor is coupled to the current mirror and a current path of the control transistor is coupled to the common terminal.*

*50. A BiCMOS band-gap reference voltage circuit as in claim 43, wherein each of the device and the voltage regulator device include respective current paths, and wherein each respective current path is coupled to the current mirror.*

*51. A BiCMOS band-gap reference voltage circuit as in claim 43, wherein the band-gap reference sub-circuit comprises a control transistor having a control terminal and a current path, the control terminal coupled to the voltage regulator device.*

*52. A band-gap reference voltage circuit comprising:*

*a device capable of producing a substantially constant reference current;*

*a band-gap reference sub-circuit coupled to said reference current device, operable to transmit a substantially constant reference voltage output;*

*a voltage regulator device;*

*a current mirror comprising a plurality of field effect transistors being operable to mirror said reference current from said reference current producing device to said voltage regulator device; and*

*a diode coupled between the current mirror and the voltage regulator device.*

*53. A band-gap reference voltage circuit as in claim 52, comprising bipolar and field effect transistors.*

*54. A band-gap reference voltage circuit as in claim 52, wherein the device includes a control terminal and a current path, the current path being connected to a voltage supply terminal without an intervening transistor.*

*55. A band-gap reference voltage circuit as in claim 52, comprising a start-up circuit coupled to the diode.*

*56. A band-gap reference voltage circuit as in claim 52, wherein the band-gap reference sub-circuit comprises plural current paths coupled between a common terminal and a reference terminal, and wherein the start-up circuit is coupled between the current mirror and the common terminal.*

*57. A band-gap reference voltage circuit as in claim 52, comprising a start-up circuit, wherein the band-gap reference sub-circuit comprises plural current paths coupled between a common terminal and a reference terminal, and wherein the start-up circuit is coupled to the common terminal.*

*58. A band-gap reference voltage circuit as in claim 52, wherein the band-gap reference sub-circuit comprises a control transistor having a control terminal and a current path, the control terminal coupled to the current mirror and the current path coupled to the common terminal.*

*59. A band-gap reference voltage circuit as in claim 52, wherein each of the device and the voltage regulator device include respective current paths, and wherein each respective current path is coupled to the current mirror.*

*60. A band-gap reference voltage circuit as in claim 52, wherein the band-gap reference sub-circuit comprises a control transistor having a control terminal and a current path, the control terminal coupled to the voltage regulator device.*

*61. A band-gap reference voltage circuit as in claim 52, wherein the device includes a control terminal, and wherein the band-gap reference sub-circuit comprises a control transistor having a control terminal and a current path, and the current path of the control transistor coupled to the control terminal of the device.*

*62. A band-gap reference voltage circuit comprising:*

*a device capable of producing a substantially constant reference current;*

*a band-gap reference sub-circuit coupled to said reference current device, operable to transmit a substantially constant reference voltage output, the band-gap reference sub-circuit having plural current paths coupled between a common terminal and a reference terminal;*

*a voltage regulator device;*

*a current mirror comprising a plurality of field effect transistors being operable to mirror said reference current from said reference current producing device to said voltage regulator device; and*

*a start-up circuit coupled between the current mirror and the common terminal.*

*63. A band-gap reference voltage circuit as in claim 62, comprising bipolar and field effect transistors.*

*64. A band-gap reference voltage circuit as in claim 62, wherein the device includes a control terminal and a current path, the current path being connected to a voltage supply terminal without an intervening transistor.*

*65. A band-gap reference voltage circuit as in claim 62, comprising a diode coupled to the start-up circuit.*

*66. A band-gap reference voltage circuit as in claim 62, wherein the start-up circuit is coupled to the voltage regulator device.*

*67. A band-gap reference voltage circuit as in claim 62, wherein the start-up circuit is coupled to the common terminal.*

*68. A band-gap reference voltage circuit as in claim 62, wherein the band-gap reference sub-circuit comprises a control transistor having a control terminal and a current path, the control terminal coupled to the current mirror and the current path coupled to the common terminal.*

*69. A band-gap reference voltage circuit as in claim 62, wherein each of the device and the voltage regulator device include respective current paths, and wherein each respective current path is coupled to the current mirror.*

*70. A band-gap reference voltage circuit as in claim 62, wherein the band-gap reference sub-circuit comprises a control transistor having a control terminal and a current path, the control terminal coupled to the voltage regulator device.*

*71. A band-gap reference voltage circuit as in claim 62, wherein the device includes a control terminal, and wherein the band-gap reference sub-circuit comprises a control transistor having a control terminal and a current path, and the current path of the control transistor coupled to the control terminal of the device.*

*72. A band-gap reference voltage circuit comprising:*

*a device capable of producing a substantially constant reference current;*

*a band-gap reference sub-circuit coupled to said reference current device, operable to transmit a substan-*

*tially constant reference voltage ouput, the band-gap reference sub-circuit having plural current paths coupled between a common terminal and a reference terminal;*

*a voltage regulator device;*

*a current mirror comprising a plurality of field effect transistors being operable to mirror said reference current from said reference current producing device to said voltage regulator device; and*

*a start-up circuit coupled to the common terminal.*

*73. A band-gap reference voltage circuit as in claim 72, comprising bipolar and field effect transistors.*

*74. A band-gap reference voltage circuit as in claim 72, wherein the device includes a control terminal and a current path, the current path being connected to a voltage supply terminal without an intervening transistor.*

*75. A band-gap reference voltage circuit as in claim 72, comprising a diode coupled to the current mirror, wherein the start-up circuit coupled to the diode.*

*76. A band-gap reference voltage circuit as in claim 72, wherein the start-up circuit is coupled to the voltage regulator device.*

*77. A band-gap reference voltage circuit as in claim 72, wherein the start-up circuit is coupled to the current mirror.*

*78. A band-gap reference voltage circuit as in claim 72, wherein the band-gap reference sub-circuit comprises a control transistor having a control terminal and a current path, the control terminal coupled to the current mirror and the current path coupled to the common terminal.*

*79. A band-gap reference voltage circuit as in claim 72, wherein each of the device and the voltage regulator device include respective current paths, and wherein each respective current path is coupled to the current mirror.*

*80. A band-gap reference voltage circuit as in claim 72, wherein the band-gap reference sub-circuit comprises a control transistor having a control terminal and a current path, the control terminal coupled to the voltage regulator device.*

*81. A band-gap reference voltage circuit as in claim 72, wherein the device includes a control terminal, and wherein the band-gap reference sub-circuit comprises a control transistor having a control terminal and a current path, and the current path of the control transistor coupled to the control terminal of the device.*

*82. A band-gap reference voltage circuit comprising:*

*a device capable of producing a substantially constant reference current, the device having a control terminal and a current path;*

*a band-gap reference sub-circuit coupled to said reference current device, operable to transmit a substantially constant reference voltage output, the band-gap reference sub-circuit having plural current paths coupled between a common terminal and a reference terminal and having a control transistor coupled to the common terminal and to the control terminal of the device;*

*a voltage regulator device; and*

*a current mirror comprising a plurality of field effect transistors being operable to mirror said reference current from said reference current producing device to said voltage regulator device.*

*83. A band-gap reference voltage circuit as in claim 82, comprising bipolar and field effect transistors.*

*84. A band-gap reference voltage circuit as in claim 82, wherein the device includes a control terminal and a current path, the current path being connected to a voltage supply terminal without an intervening transistor.*

*85. A band-gap reference voltage circuit as in claim 82, comprising a diode coupled to the current mirror and a start-up circuit coupled to the diode.*

*86. A band-gap reference voltage circuit as in claim 82, comprising a start-up circuit coupled to the voltage regulator device.*

*87. A band-gap reference voltage circuit as in claim 82, comprising a start-up circuit coupled to the current mirror.*

*88. A band-gap reference voltage circuit as in claim 82, wherein a control terminal of the control transistor is coupled to the current mirror and a current path of the control transistor is coupled to the common terminal.*

*89. A band-gap reference voltage circuit as in claim 82, wherein each of the device and the voltage regulator device include respective current paths, and wherein each respective current path is coupled to the current mirror.*

*90. A band-gap reference voltage circuit as in claim 82, wherein a control terminal of the control transistor is coupled to the voltage regulator device.*

*91. A band-gap reference voltage circuit comprising:*

*a device capable of producing a substantially constant reference current, the device having a current path connected to a voltage supply terminal without an intervening transistor;*

*a band-gap reference sub-circuit coupled to said reference current device, operable to transmit a substantially constant reference voltage output;*

*a voltage regulator device;*

*a current mirror being operable to mirror said reference current from said reference current producing device to said voltage regulator device; and*

*a start-up circuit coupled to the voltage regulator device.*

*92. A band-gap reference voltage circuit as in claim 91, wherein the current mirror comprises a plurality of field effect transistors.*

*93. A band-gap reference voltage circuit as in claim 91, comprising a diode coupled between the voltage regulator device and the current mirror.*

*94. A band-gap reference voltage circuit as in claim 91, comprising a diode coupled to the start-up circuit.*

*95. A band-gap reference voltage circuit as in claim 91, wherein the start-up circuit is coupled to the current mirror.*

*96. A band-gap reference voltage circuit as in claim 91, wherein the band-gap reference sub-circuit comprises plural current paths coupled between a common terminal and a reference terminal, and wherein the start-up circuit is coupled between the current mirror and the common terminal.*

*97. A band-gap reference voltage circuit as in claim 91, wherein the band-gap reference sub-circuit comprises plural current paths coupled between a common terminal and a reference terminal, and wherein the start-up circuit is coupled to the common terminal.*

*98. A band-gap reference voltage circuit as in claim 91, wherein the band-gap reference sub-circuit comprises a control transistor having a control terminal and a current path, the control terminal coupled to the current mirror and the current path coupled to the common terminal.*

*99. A band-gap reference voltage circuit as in claim 91, wherein each of the device and the voltage regulator device include respective current paths, and wherein each respective current path is coupled to the current mirror.*

*100. A band-gap reference voltage circuit as in claim 91, wherein the band-gap reference sub-circuit comprises a control transistor having a control terminal and a current path, the control terminal coupled to the voltage regulator device.*

*101. A band-gap reference voltage circuit as in claim 91, wherein the device includes a control terminal, and wherein the band-gap reference sub-circuit comprises a control transistor having a control terminal and a current path, and the current path of the control transistor coupled to the control terminal of the device.*

*102. A band-gap reference voltage circuit comprising:*

*a device capable of producing a substantially constant reference current;*

*a band-gap reference sub-circuit coupled to said reference current device, operable to transmit a substantially constant reference voltage output, the band-gap reference sub-circuit having plural current paths coupled between a common terminal and a reference terminal;*

*a start-up circuit coupled to the common terminal;*

*a voltage regulator device;*

*a current mirror being operable to mirror said reference current from said reference current producing device to said voltage regulator device; and*

*a diode coupled between the voltage regulator device and the current mirror.*

*103. A band-gap reference voltage circuit as in claim 102, wherein the device includes a control terminal and a current path, the current path being connected to a voltage supply terminal without an intervening transistor.*

*104. A band-gap reference voltage circuit as in claim 102, wherein the start-up circuit is coupled to the diode.*

*105. A band-gap reference voltage circuit as in claim 102, wherein the start-up circuit is coupled to the voltage regulator device.*

*106. A band-gap reference voltage circuit as in claim 102, wherein the start-up circuit is coupled to the current mirror.*

*107. A band-gap reference voltage circuit as in claim 102, wherein the start-up circuit is coupled between the current mirror and the common terminal.*

*108. A band-gap reference voltage circuit as in claim 102, wherein the band-gap reference sub-circuit comprises a control transistor having a control terminal and a current path, the control terminal coupled to the current mirror and the current path coupled to the common terminal.*

*109. A band-gap reference voltage circuit as in claim 102, wherein each of the device and the voltage regulator device include respective current paths, and wherein each respective current path is coupled to the current mirror.*

*110. A band-gap reference voltage circuit as in claim 102, wherein the band-gap reference sub-circuit comprises a control transistor having a control terminal and a current path, the control terminal coupled to the voltage regulator device.*

*111. A band-gap reference voltage circuit as in claim 102, wherein the device includes a control terminal, and wherein the band-gap reference sub-circuit comprises a control transistor having a control terminal and a current path, and the current path of the control transistor coupled to the control terminal of the device.*

*112. A band-gap reference voltage circuit comprising:*

*a device capable of producing a substantially constant reference current;*

*a band-gap reference sub-circuit coupled to said reference current device, operable to transmit a substantially constant reference voltage output, the band-gap reference sub-circuit having plural current paths coupled between a common terminal and a reference terminal and having a control transistor coupled to the common terminal and to the control terminal of the device;*

*a voltage regulator device;*

*a current mirror coupled to a control terminal of the control transistor, said current mirror being operable to mirror said reference current from said reference current producing device to said voltage regulator device; and*

*a diode coupled between the voltage regulator device and the current mirror.*

*113. A band-gap reference voltage circuit as in claim 112, wherein the device includes a control terminal and a current path, the current path being connected to a voltage supply terminal without an intervening transistor.*

*114. A band-gap reference voltage circuit as in claim 112, comprising a start-up circuit coupled to the diode.*

*115. A band-gap reference voltage circuit as in claim 112, comprising a start-up circuit coupled to the voltage regulator device.*

*116. A band-gap reference voltage circuit as in claim 112, comprising a start-up circuit coupled to the current mirror.*

*117. A band-gap reference voltage circuit as in claim 112, comprising a start-up circuit coupled between the current mirror and the common terminal.*

*118. A band-gap reference voltage circuit as in claim 112, comprising a start-up circuit coupled to the common terminal.*

*119. A band-gap reference voltage circuit as in claim 112, wherein each of the device and the voltage regulator device include respective current paths, and wherein each respective current path is coupled to the current mirror.*

*120. A band-gap reference voltage circuit as in claim 112, wherein a control terminal of the control transistor is coupled to the voltage regulator device.*

*121. A band-gap reference voltage circuit as in claim 112, wherein a current path of the control transistor is coupled to the control terminal of the device.*

*122. A band-gap reference voltage circuit comprising:*

*a device capable of producing a substantially constant reference current;*

*a band-gap reference sub-circuit coupled to said reference current device, operable to transmit a substantially constant reference voltage output;*

*a voltage regulator device;*

*a current mirror being operable to mirror said reference current from said reference current producing device to said voltage regulator device;*

*a diode coupled to the current mirror; and*

*a start-up circuit coupled to the diode.*

*123. A band-gap reference voltage circuit as in claim 122, comprising bipolar and field effect transistors.*

*124. A band-gap reference voltage circuit as in claim 122, wherein the current mirror comprises a plurality of field effect transistors.*

*125. A band-gap reference voltage circuit as in claim 122, wherein the device includes a control terminal and a current path, the current path being connected to a voltage supply terminal without an intervening transistor.*

*126. A band-gap reference voltage circuit as in claim 122, wherein the diode is coupled between the voltage regulator device and the current mirror.*

*127. A band-gap reference voltage circuit as in claim 122, wherein the start-up circuit is coupled to the voltage regulator device.*

*128. A band-gap reference voltage circuit as in claim 122, wherein the start-up circuit is coupled to the current mirror.*

*129. A band-gap reference voltage circuit as in claim 122, wherein the band-gap reference sub-circuit comprises plural*

*current paths coupled between a common terminal and a reference terminal, and wherein the start-up circuit is coupled between the current mirror and the common terminal.*

*130. A band-gap reference voltage circuit as in claim 122, wherein the start-up circuit is coupled to the common terminal.*

*131. A band-gap reference voltage circuit as in claim 122, wherein the band-gap reference sub-circuit comprises a control transistor having a control terminal and a current path, the control terminal coupled to the current mirror and the current path coupled to the common terminal.*

*132. A band-gap reference voltage circuit as in claim 122, wherein each of the device and the voltage regulator device include respective current paths, and wherein each respective current path is coupled to the current mirror.*

*133. A band-gap reference voltage circuit as in claim 122, wherein the band-gap reference sub-circuit comprises a control transistor having a control terminal and a current path, the control terminal coupled to the voltage regulator device.*

*134. A band-gap reference voltage circuit as in claim 122, wherein the device includes a control terminal, and wherein the band-gap reference sub-circuit comprises a control transistor having a control terminal and a current path, and the current path of the control transistor coupled to the control terminal of the device.*

*135. A band-gap reference voltage circuit comprising:*

*a device capable of producing a substantially constant reference current;*

*a band-gap reference sub-circuit coupled to said reference current device, operable to transmit a substantially constant reference voltage output, the band-gap reference sub-circuit having plural current paths coupled between a common terminal and a reference terminal and having a control transistor coupled to the common terminal and to the control terminal of the device;*

*a voltage regulator device;*

*a start-up circuit coupled to the voltage regulator device; and*

*a current mirror coupled to a control terminal of the control transistor, said current mirror being operable to mirror said reference current from said reference current producing device to said voltage regulator device.*

*136. A band-gap reference voltage circuit as in claim 135, comprising bipolar and field effect transistors.*

*137. A band-gap reference voltage circuit as in claim 135, wherein the current mirror comprises a plurality of field effect transistors.*

*138. A band-gap reference voltage circuit as in claim 135, wherein the device includes a control terminal and a current path, the current path being connected to a voltage supply terminal without an intervening transistor.*

*139. A band-gap reference voltage circuit as in claim 135, comprising a diode coupled to the current mirror, wherein the start-up circuit is coupled to the diode.*

*140. A band-gap reference voltage circuit as in claim 135, wherein the start-up circuit is coupled to the current mirror.*

*141. A band-gap reference voltage circuit as in claim 135, wherein the start-up circuit is coupled between the current mirror and the common terminal.*

*142. A band-gap reference voltage circuit as in claim 135, wherein the start-up circuit is coupled to the common terminal.*

*143. A band-gap reference voltage circuit as in claim 135, wherein each of the device and the voltage regulator device include respective current paths, and wherein each respective current path is coupled to the current mirror.*

*144. A band-gap reference voltage circuit as in claim 135, wherein a control terminal of the control transistor is coupled to the voltage regulator device.*

*145. A band-gap reference voltage circuit as in claim 135, wherein a current path of the control transistor is coupled to a control terminal of the device.*

* * * * *